US008947474B2

(12) United States Patent
Kim et al.

(10) Patent No.: US 8,947,474 B2
(45) Date of Patent: Feb. 3, 2015

(54) LIQUID CRYSTAL DISPLAY DEVICE

(71) Applicant: LG Display Co., Ltd., Seoul (KR)

(72) Inventors: Hak Su Kim, Daegu (KR); Young Kyu Shin, Cheongju-si (KR)

(73) Assignee: LG Display Co., Ltd., Seoul (KR)

( * ) Notice: Subject to any disclaimer, the term of this patent is extended or adjusted under 35 U.S.C. 154(b) by 44 days.

(21) Appl. No.: 13/712,672

(22) Filed: Dec. 12, 2012

(65) Prior Publication Data

US 2013/0147781 A1 Jun. 13, 2013

(30) Foreign Application Priority Data

Dec. 12, 2011 (KR) ..... 10-2011-0133306

(51) Int. Cl.
*G09G 5/10* (2006.01)
*G09G 3/36* (2006.01)

(52) U.S. Cl.
CPC ..... *G09G 3/3685* (2013.01); *G09G 3/3614* (2013.01); *G09G 3/3696* (2013.01); *G09G 3/3648* (2013.01); *G09G 3/3666* (2013.01); *G09G 2310/0232* (2013.01); *G09G 2320/0214* (2013.01); *G09G 2320/0223* (2013.01); *G09G 2320/0233* (2013.01); *G09G 2320/0252* (2013.01); *G09G 2320/0673* (2013.01)
USPC ..... 345/690; 345/208

(58) Field of Classification Search
CPC . G09G 3/3685; G09G 3/3666; G09G 3/3696; G09G 3/3614; G09G 3/3648; G09G 2320/0673
USPC ..... 345/208–211, 690–699
See application file for complete search history.

(56) References Cited

U.S. PATENT DOCUMENTS

| | | | | |
|---|---|---|---|---|
| 5,745,092 | A * | 4/1998 | Ito | 345/95 |
| 6,963,325 | B2 | 11/2005 | Yano et al. | |
| 7,151,518 | B2 | 12/2006 | Fukumoto et al. | |
| 7,227,560 | B2 * | 6/2007 | Kudo et al. | 345/690 |
| 2003/0048248 | A1 | 3/2003 | Fukumoto et al. | |
| 2009/0115772 | A1 | 5/2009 | Shiomi et al. | |
| 2011/0216058 | A1 | 9/2011 | Oh | |
| 2011/0279431 | A1 | 11/2011 | Lee et al. | |

FOREIGN PATENT DOCUMENTS

| | | | |
|---|---|---|---|
| CN | 102194426 | A | 9/2011 |
| CN | 102254525 | A | 11/2011 |
| EP | 1 293 957 | B1 | 3/2003 |
| JP | 2003-84725 | A | 3/2003 |
| JP | 2003-84737 | A | 3/2003 |
| KR | 10-2011-0024993 | A | 3/2011 |

* cited by examiner

*Primary Examiner* — Michael Pervan
(74) *Attorney, Agent, or Firm* — Birch, Stewart, Kolasch & Birch, LLP

(57) ABSTRACT

An LCD device is discussed which includes: a plurality of gate lines and a plurality of data lines arranged on a substrate; a data driver configured to apply data voltages the data lines; a gamma generator configured to apply a plurality of gamma voltages to the data driver, wherein the data line receives the data voltage which has an inverted polarity to those of data voltages on the adjacent data lines thereto, is inverted n times in polarity for every frame, and is over-driven for the gate lines opposite to time points of the polarity inversions.

5 Claims, 6 Drawing Sheets

FIG.1

| 1 Frame | 2 Frame |
|---|---|
| + − + − · · · + − + − | − + − + · · · − + − + |
| + − + − · · · + − + − | − + − + · · · − + − + |
| + − + − · · · + − + − | − + − + · · · − + − + |
| + − + − · · · + − + − | − + − + · · · − + − + |
| ⋮ ⋮ | ⋮ ⋮ |
| + − + − · · · + − + − | − + − + · · · − + − + |
| + − + − · · · + − + − | − + − + · · · − + − + |
| + − + − · · · + − + − | − + − + · · · − + − + |
| + − + − · · · + − + − | − + − + · · · − + − + |

FIG.3

| | 1 Frame | 2 Frame |
|---|---|---|
| 320 Gate Line | + − + − ··· + − + − | − + − + ···− + − + |
| | + − + − ··· + − + − | − + − + ···− + − + |
| | ⋮ ⋮ | ⋮ ⋮ |
| | + − + − ··· + − + − | − + − + ···− + − + |
| | + − + − ··· + − + − | − + − + ···− + − + |
| 320 Gate Line | − + − + ···− + − + | + − + − ··· + − + − |
| | − + − + ···− + − + | + − + − ··· + − + − |
| | ⋮ ⋮ | ⋮ ⋮ |
| | − + − + ···− + − + | + − + − ··· + − + − |
| | − + − + ···− + − + | + − + − ··· + − + − |
| 320 Gate Line | + − + − ··· + − + − | − + − + ···− + − + |
| | + − + − ··· + − + − | − + − + ···− + − + |
| | ⋮ ⋮ | ⋮ ⋮ |
| | + − + − ··· + − + − | − + − + ···− + − + |
| | + − + − ··· + − + − | − + − + ···− + − + |
| 320 Gate Line | − + − + ···− + − + | + − + − ··· + − + − |
| | − + − + ···− + − + | + − + − ··· + − + − |
| | ⋮ ⋮ | ⋮ ⋮ |
| | − + − + ···− + − + | + − + − ··· + − + − |
| | − + − + ···− + − + | + − + − ··· + − + − |

LIQUID CRYSTAL DISPLAY DEVICE

The present application claims priority under 35 U.S.C. §119(a) of Korean Patent Application No. 10-2011-0133306 filed on Dec. 12, 2011, which is hereby incorporated by reference in its entirety.

BACKGROUND

1. Field of the Disclosure

The present application relates to a liquid crystal display device.

2. Description of the Related Art

A variety of display devices adapted to display information are being developed. The display devices include liquid crystal display (LCD) devices, plasma display panel (PDP) devices, electrophoresis display devices, organic light-emitting display (OLED) devices and semiconductor light-emitting display devices, as an example.

Among these display devices, LCD devices have the features of superior picture quality, lighter weight, slimness, lower power consumption and so on. As such, the OLED device is considered to be next generation display devices. Such LCD devices are being widely applied to, for example, mobile phones, navigation systems, notebook computers, television receivers or others.

The LCD device controls light transmittance of a liquid crystal cell on an LCD panel according to a gray level value of the data in order to display an image on the LCD panel. The light transmission property of a liquid crystal cell disposed on the LCD panel is deteriorated in case a fixed DC voltage is continuously applied to the liquid crystal cell for a long time. Such DC voltage fixedness causes a residual image to be included in a desired image displayed on the LCD panel. Due to this, picture quality can be deteriorated.

To prevent the DC voltage fixedness, an inversion mod LCD device is proposed which inverts pixel data voltages, which will be applied to the liquid crystal cell on the LCD panel, on the basis of a common voltage.

FIG. 1 is a data sheet illustrating an image on an LCD panel being driven in a column inversion mode of the related art.

Referring to FIG. 1, the LCD panel of a column inversion mode enables each data line to driven in inverted polarity with respect to adjacent data lines.

For example, in a first frame, odd-numbered data lines are driven in a positive polarity, but even-numbered data lines are driven in a negative polarity. In a second frame, the odd-numbered data lines are driven in the negative polarity, but the even-number data lines are driven in the positive polarity. Therefore, deterioration of an image can be prevented.

Such a column inversion mode allows the data voltage being applied to a data line to be invented in polarity whenever one frame is exchanged with another frame. For example, if positive data voltage is applied to the first data line for a first frame, negative data voltage is applied to the first data line for a second frame. However, the pixel regions on the first gate line cannot be substantially charged with the negative data voltage due to variation of the data voltage from the positive polarity to the negative polarity. The polarity variation of the data voltage causes a current to leak out from the pixel regions on the first gate line. Therefore, picture quality can deteriorates.

BRIEF SUMMARY

Accordingly, embodiments of the present application are directed to a liquid crystal display device that substantially obviates one or more of problems due to the limitations and disadvantages of the related art.

The embodiments are to provide a liquid crystal device that is adapted to enhance picture quality.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a first general aspect of the present embodiment, an LCD device includes: a plurality of gate lines and a plurality of data lines arranged on a substrate; a data driver configured to apply data voltages the data lines; a gamma generator configured to apply a plurality of gamma voltages to the data driver, wherein the data line receives the data voltage which has an inverted polarity to those of data voltages on the adjacent data lines thereto, is inverted n times in polarity for every frame, and is over-driven for the gate lines opposite to time points of the polarity inversions.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings:

FIG. 1 is a data sheet illustrating an image on an LCD panel being driven in a column inversion mode of the related art;

FIG. 3 is a data sheet illustrating a scheme of driving an LCD panel according to an embodiment of the present disclosure;

DETAILED DESCRIPTION OF THE EMBODIMENTS

Figure 2:
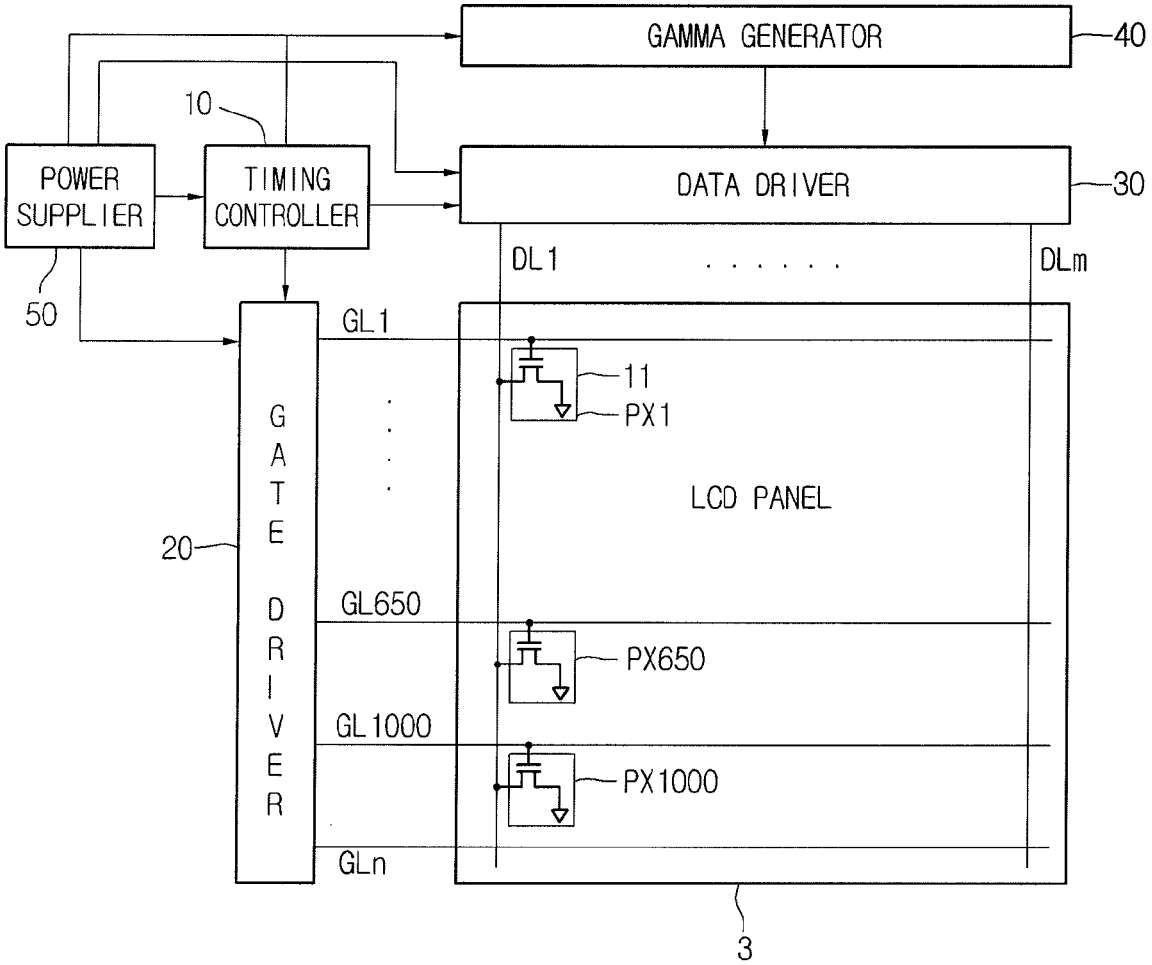
FIG. 2 is a block diagram showing an LCD device according to an embodiment of the present disclosure.

In the present disclosure, it will be understood that when an element, such as a substrate, a layer, a region, a film, or an electrode, is referred to as being formed "on" or "under"

another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 2 is a block diagram showing an LCD device according to an embodiment of the present disclosure.

Referring to FIG. 2, the LCD device according to an embodiment of the present disclosure can include an LCD panel 3, a timing controller 10, a gate driver 20, a data driver 30, a gamma generator 40 and a power supplier 50.

A plurality of gate lines GL1~GLn and a plurality of data lines DL1~DLm can be formed on the LCD panel 3. The plurality of gate lines GL1~GLn and the plurality of data lines DL1~DLm crossing each other can define pixel regions PX. A thin film transistor 11 can be formed in each pixel region PX on the LCD panel 3.

The thin film transistor 11 can be electrically connected to one of the gate lines GL1~GLn and one of the data lines DL1~DLm. The thin film transistor 11 is turned-on/off by a gate signal applied the gate line and transmits a data voltage applied from the data line to a pixel electrode, thereby controlling liquid crystal molecular displacement. In accordance therewith, an image can be displayed on the LCD panel 3. To this end, the thin film transistor 11 includes: a gate electrode electrically connected to one of the gate lines GL1~GLn which is used to transfer the gate signal; a drain electrode electrically connected to one of the data lines DL1~DLm which is used to transfer the data voltage; and a source electrode electrically connected to the pixel electrode which is used to control the liquid crystal molecular displacement.

For example, the pixel region connected to a first gate line GL1 and a first data line DL1 can be referred to as a first pixel PX1. Also, the pixel region connected to a $650^{th}$ gate line GL650 and the first data line DL1 can be referred to as a 650th pixel PX650. Moreover, the pixel region connected to a 1000th gate line GL1000 and the first data line DL1 can be referred to as a 1000th pixel PX1000.

The timing controller 10 can receive a data clock signal Dclk, a vertical synchronous signal Vsync and a horizontal synchronous signal Hsync together with data signals from an external graphic card.

Also, the timing controller 10 can derive timing control signals, which are used to control the gate driver 20 and the data driver 30, from the data clock signal Dclk, the vertical synchronous signal Vsync and the horizontal synchronous signal Hsync. The timing control signals can include gate control signals and data control signals.

The gate control signals can include a gate start signal GSP, a gate shift clock GSC, a gate output enable signal GOE, as an example. The gate start pulse GSP is used to control a driving start time point of the first gate line GL1 of the LCD panel 3 in every frame. The gate shift clock GSC is used to sequentially control driving start time points of the gate lines GL1~GLn of the LCD panel 3. The gate output enable signal GOE is used to control time points when the gate signals are applied to the respective gate lines GL1~GLn.

The data control signals can include a source start pulse SSP, a source shift clock SSC, a source output enable signal SOE, a polarity signal POL and so on. The source start pulse SSP is used to control a supply start time point for one line of data signals every horizontal period. The source shift clock SSC is used to sequentially control supply time points of the data signals. The source output enable signal SOE is used to control a supply time point for one line of data voltages which are applied from the data driver to the LCD panel 3. The polarity signal POL is used to select polarities of the data voltages. In other words, the polarity signal POL enables each of the data voltages to selectively have one of a positive level and a negative level.

Moreover, the timing controller 10 can rearrange the data signals applied from the graphic card in a data format required by the data driver 30.

The gate control signals can be applied from the timing controller 10 to the gate driver 20. The rearranged data signals and the data control signals are applied from the timing controller 10 to the data driver 30.

The gate driver 20 can sequentially generate the gate signals using the gate control signals applied from the timing controller 10. Also, the gate driver 20 can applies the gate signals to the respective gate lines GL1~GLn.

The data driver 30 can reply to the data control signals applied from the timing controller 10 and supply the plurality of data lines DL1~DLm with data voltages opposite to the data signals applied from the timing controller 10.

The gamma generator 40 can derive a plurality of gamma voltages from a supply voltage which is applied from the power supplier 50. The power supply unit 50 can be included in the timing controller 10. The number of gamma voltages is the same as the number of gray levels. Such gamma voltages are applied from the gamma generator 40 to the data driver 30.

The power supplier 50 can generate driving voltages which are used to drive the timing controller 10, the gate driver 20, the data driver 30 and the gamma generator 40. The driving voltages are applied to the timing controller 10, the gate driver 20, the data driver 30 and the gamma generator 40. Also, the power supplier 50 can further generate the supply voltage which is used to generate the gamma voltages.

FIG. 3 is a data sheet illustrating a scheme of driving a LCD panel according to an embodiment of the present disclosure.

As shown in FIG. 3, the present embodiment allows the LCD panel 3 to be driven in a four divisional column inversion mode. The four divisional column inversion mode divides the LCD panel 3 into four areas according to the gate lines GL1~GLn and drives the four areas to be driven in the column mode. In detail, each area can be driven in the column mode and in different polarity from adjacent areas. For example, each area can be defined to include pixel regions opposite to 320 gate lines.

A first area can be defined to include the pixel regions opposite to first through $320^{th}$ gate lines GL1~GL320. A second area can be defined to include the pixel regions opposite to $321^{st}$ through $640^{th}$ gate lines. A third area can be defined to include the pixel regions opposite to $641^{st}$ through $960^{th}$ gate lines GL641~GL960. A fourth area can be defined to include the pixel regions opposite to $961^{st}$ through $1280^{th}$ gate lines GL961~GL1200.

In a first frame, odd-numbered data lines within the first and third areas can be driven in the positive polarity, but even-numbered data lines the first and third areas can be driven in the negative polarity. As such, the odd-numbered data lines within the second and fourth areas can be driven in the negative polarity, but even-numbered data lines within the second and fourth areas can be driven in the positive polarity, in the first frame.

Also, the odd-numbered data lines within the first and third areas can be driven in the negative polarity, but even-numbered data lines within the first and third divided areas can be driven in the positive polarity, in a second frame. Then, the odd-numbered data lines within the second and fourth areas can be driven in the positive polarity, but even-numbered data lines within the second and fourth areas can be driven in the negative polarity, in the second frame.

In this way, each area on the LCD panel 3 is driven in the column mode and in different polarity from adjacently divided areas.

Figure 4:
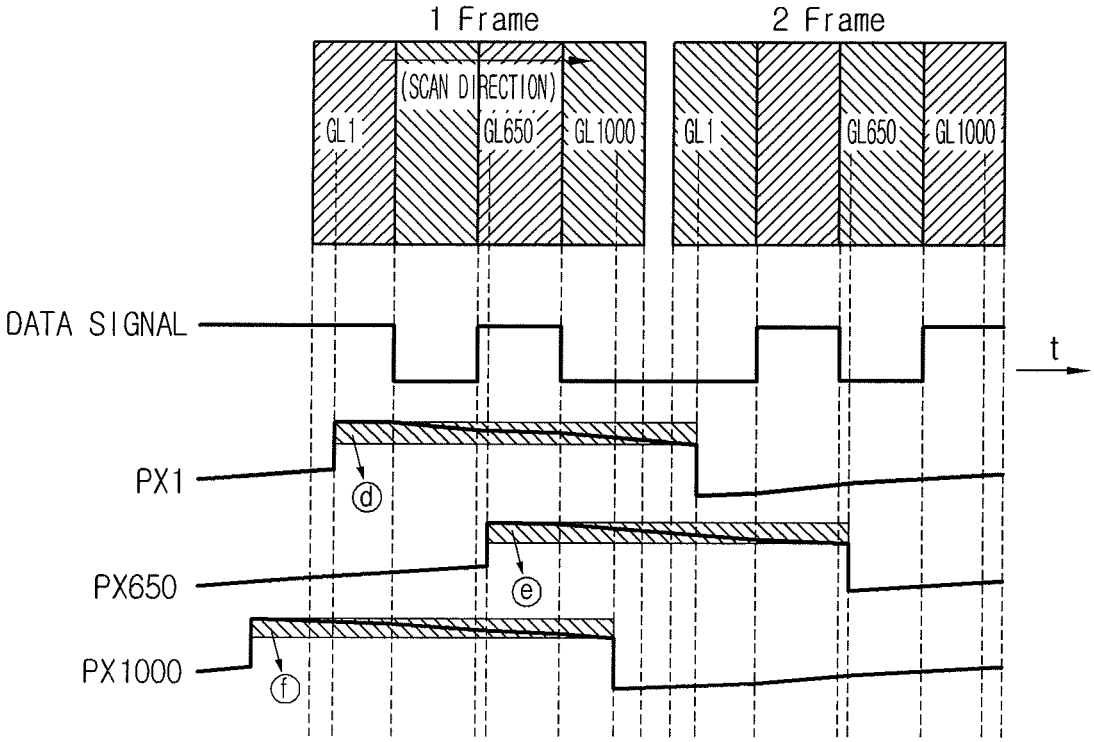
FIG. 4 is a data sheet illustrating voltage variation within a pixel region of an LCD device according to an embodiment of the present disclosure.

FIG. 4 is a data sheet illustrating voltage variation within a pixel region of a liquid crystal display device according to an embodiment of the present disclosure.

As shown in FIG. 4, the LCD panel 3 of the present embodiment can be driven in such a manner as to be divided into four areas, during a single frame.

If the LCD panel 3 includes 1280 gate lines, a first area including first through $320^{th}$ gate lines, a second area including $321^{st}$ through $640^{th}$ gate lines, a third area including $641^{st}$ through 960 gate lines, and a four area including $961^{st}$ through 1280 gate lines can be sequentially driven for a single frame. In FIG. 4, variations of voltages in a first, $650^{th}$ and $1000^{th}$ pixel regions PX1, PX650 and PX1000 will now be described, as examples. The first pixel region PX1 is connected to the first gate line GL1 within the first area, the $650^{th}$ pixel region PX650 is connected to the $650^{th}$ gate line GL650 within the third area, and the $1000^{th}$ pixel region PX1000 is connected to the $1000^{th}$ gate line GL1000 within the fourth area.

In a first frame, the first and third areas can each receive the data voltage with a positive polarity, but the second and fourth areas can each receive the data voltage with a negative polarity. Meanwhile, the first and third areas can each receive the data voltage with the negative polarity, but the second and fourth areas can each receive the data voltage with the positive polarity.

In detail, the data voltage on first data line DL1 can vary in a sequence of positive, negative, positive and negative polarities along the first through fourth areas for the first frame. Then, the first and $650^{th}$ pixel regions PX1 and PX650 are charged with the positive data voltage, but the $1000^{th}$ pixel region PX1000 is charged with the negative data voltage, in the first frame. Subsequently, the data voltage can vary in a sequence of negative, positive, negative and positive polarities along the first through fourth areas for a second frame. As such, the voltages charged in the first and $650^{th}$ pixel regions PX1 and PX650 can vary from the positive data voltage to the negative data voltage, but the voltage charged in the $1000^{th}$ pixel region PX1000 can vary from the negative data voltage to the positive data voltage. Whenever the polarity of the data voltage applied to each area is inverted, a current leaks out from each of the first, $650^{th}$ and $1000^{th}$ pixel regions PX1, PX650 and PX1000. The current leakage quantities of the first, $650^{th}$ and $1000^{th}$ pixel regions caused by the polarity inversion of the data voltage are almost the same as one another. In other words, a current leakage difference between the first through fourth areas can be reduced. As such, a difference between the voltages charged in the pixel regions can also be reduced. In accordance therewith, an image with uniform picture quality can be displayed.

However, the four divisional column inversion mode cannot display an image with desired picture quality. This results from the fact that rising and falling times of the data voltages being charged in a first row of pixel regions within each area are delayed from a time point when the polarities of the data voltages are inverted, due to resistor and capacitor components of the data lines.

Figure 5:
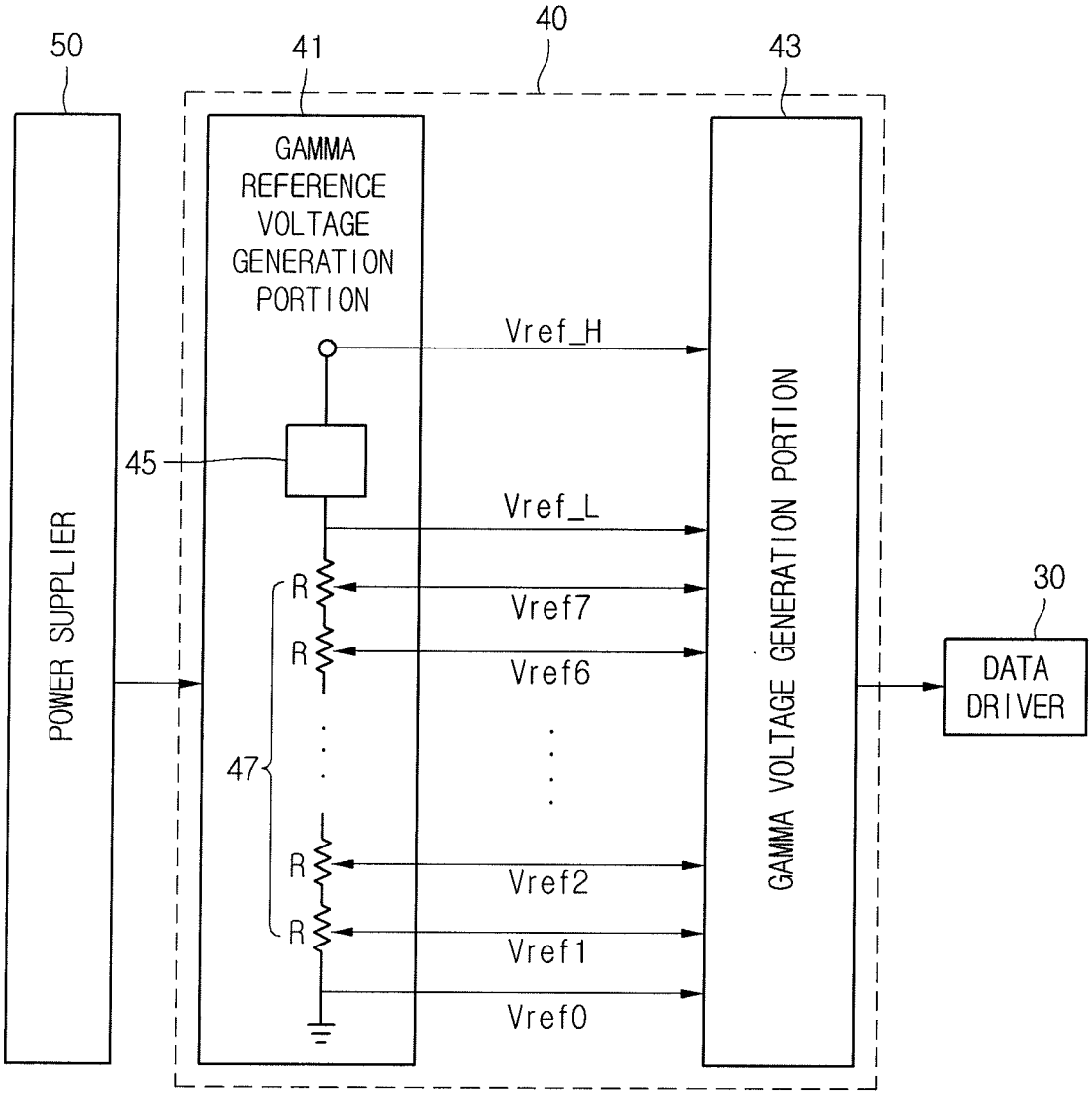
FIG. 5 is a circuit diagram showing a gamma generator, a power supplier and a data driver which are included in an LCD device.

FIG. 5 is a circuit diagram showing a gamma generator, a power supplier and a data driver which are included in a liquid crystal display device.

Referring to FIG. 5, the gamma generator of the LCD device according to the present embodiment can include a gamma reference generation portion 40 and a gamma voltage generation portion 43.

The gamma generator 40 can generate the gamma voltages opposite to gray levels, in which the data signal applied to the timing controller 10 can be varied, using the supply voltage applied from the power supplier 50 and apply the gamma voltages to the data driver 30. This gamma generator 40 can be included in any one of the timing controller 10 and the data driver 30. Alternatively, a part of the gamma generator 40 can be included in the date driver 30, and the rest of the gamma generator 40 can be included in the timing controller 10.

The power supplier 50 receives an external voltage and derives drive voltages from the external voltage. The drive voltages have different levels from one another and are used to drive the components of the LCD device. The drive voltages are applied to the respective components of the LCD device. As such, the gamma generator 40 can generate the gamma voltages using the supply voltage applied from the power supplier 50.

The gamma reference voltage generation portion 41 can generate a plurality of gamma reference voltages using the supply voltage applied from the power supplier 50. The gamma reference voltages can include first through eighth gamma reference voltages Vref0~Vref7. Such a gamma reference voltage generation portion 41 can include a gamma resistor train 47 and a gamma reference voltage selector 45 which are serially connected to each other.

The gamma resistor train 47 can be a serial circuit of plural resistor portions R. Each resistor portion R can include a plurality of resistors each connected between a plurality of nodes. The gamma reference voltages can be generated by selecting one of voltages at the plural nodes within each resistor portion R. The node voltage selection for the gamma reference voltages can be controlled by the gamma reference voltage selector 45.

The gamma reference voltage selector 45 can be configured to include a plurality of resistors. The gamma reference voltage selector 45 can generate a most significant gamma reference voltage. In detail, the gamma reference voltage selector 45 allows the most significant gamma reference voltage to have one of a low voltage level Vref_L and a high voltage level Vref_H. The selected voltage level of the most significant gamma reference voltage can enable each gamma reference voltage generated in the gamma resistor train 47 to have one of a normal voltage level and a relatively high voltage level to the normal voltage level. If the most significant gamma reference voltage has the high voltage level Vref_H, the first through eighth gamma reference voltages Vref1~Vref8 generated in the gamma resistor train 47 can have the relatively high voltage levels. On the contrary, when the most significant gamma reference voltage maintains the low voltage level Vref_L, the first through eighth gamma reference voltages Vref1~Vref8 generated in the gamma resistor train 47 can have the normal voltage levels.

If the first through eighth gamma reference voltages Vref1~Vref8 are set to be the relatively high voltage levels, the voltage on a node close to the gamma reference voltage selector 45 among the nodes within each resistor portion may be used as a gamma reference voltage. On the contrary, the voltage on a node remote from the gamma reference voltage selector 45 among the nodes within each resistor portion may be used as a gamma reference voltage, when the first through eighth gamma reference voltages Vref1~Vref8 are set to be the normal voltage levels.

The gamma voltage generation portion 43 can derive the gamma voltages from the gamma reference voltages applied from the gamma reference voltage generation portion 41. To the end, the gamma voltage generation portion 43 can include a plurality of resistors. The plurality of resistors within the gamma voltage generation portion 43 can be serially connected to one another. As such, the gamma voltage generation portion 43 can generate the gamma voltages by voltage-dividing the plurality of gamma reference voltages using the plurality of serially connected resistors. The gamma voltages generated in the gamma voltage generation portion 43 can be applied to the data driver 30.

When the polarity of the data voltage is inverted due to area exchange, the gamma reference voltage selector 45 selects the most significant gamma reference voltage with the high voltage level and enables the gamma resistor train 47 to generate the gamma voltages with the relatively high voltage levels. As such, the gamma voltages can have the relatively high voltage levels and then the first row pixel regions within each area can be over-driven, thereby enhancing the response speed of the first row pixel regions. In accordance therewith, the four divisional column inversion mode can prevent deterioration of picture quality caused by the resistor-capacitor (RC) delay.

Meanwhile, while the data voltage continuously maintains the same polarity, i.e., while an area is continuously driven without being exchanged with another area, the gamma reference voltage selector 45 selects the most significant gamma reference voltage with the low voltage level and enables the gamma resistor train 47 to generate the gamma voltages with the normal voltage levels. As such, the gamma voltages can have the normal voltage levels and then the regions within each area can be normally driven without over-driving. In accordance therewith, an image can be displayed using the gamma voltages with the normal voltage levels.

Figure 6:
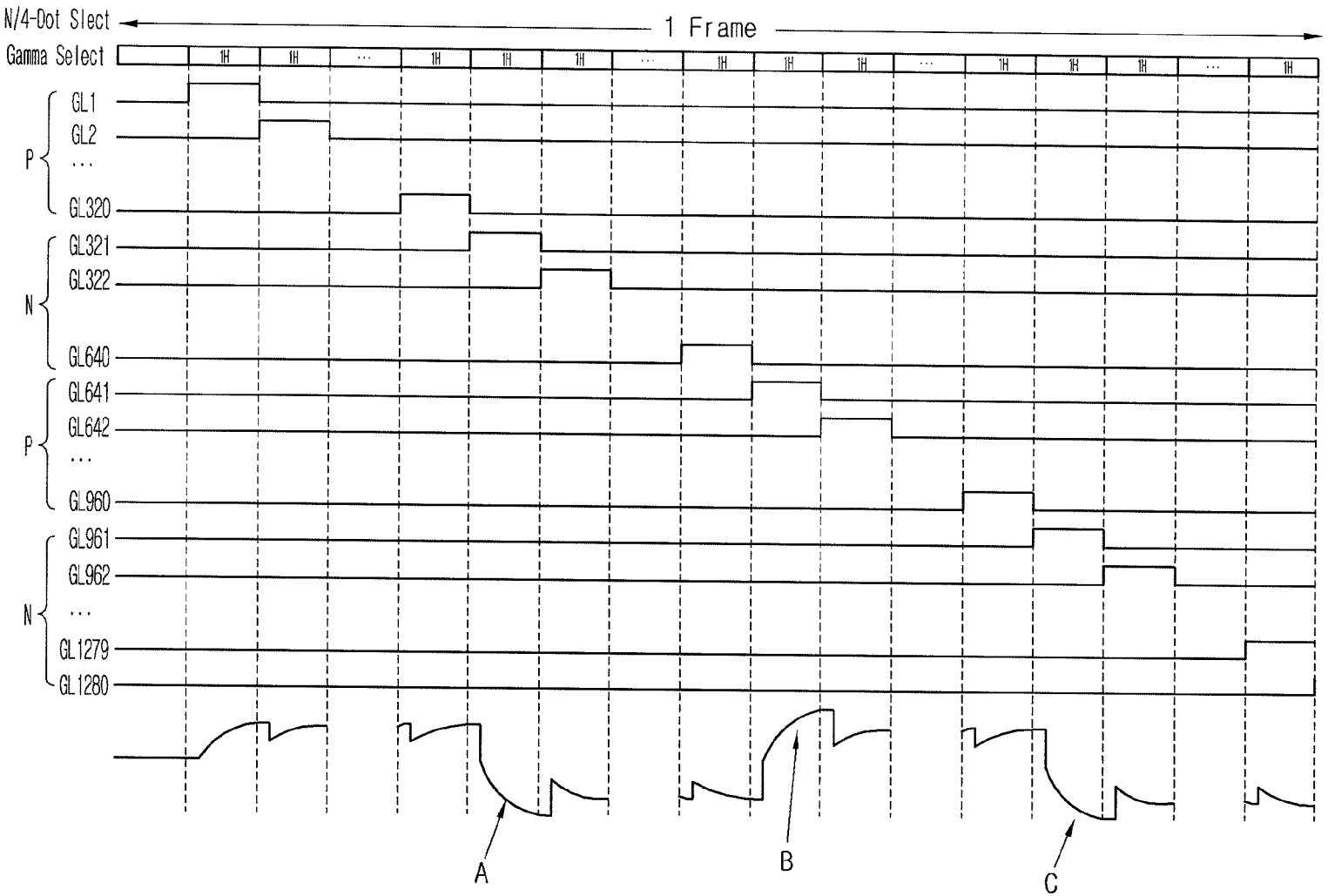
FIG. 6 is a waveform diagram illustrating variation of data voltage along gate lines in an LCD device according to an embodiment of the present disclosure.

FIG. 6 is a waveform diagram illustrating variation of data voltage along gate lines in a liquid crystal display device according to an embodiment of the present disclosure.

FIG. 6 illustrates data voltages which are applied to a first data line DL1 for only a single frame.

The data voltages applied to the first and third areas are generated using the positive gamma voltages with the positive polarity. Meanwhile, the data voltages applied to the second and fourth areas are generated using the gamma voltages with the negative polarity.

When the first area is exchanged with the second area, the data voltage being applied to the first pixel region on the $321^{st}$ gate line GL321 varies from the positive voltage level to the negative voltage level. As such, the data voltage being applied to the first pixel region on the $321^{st}$ gate line GL321 can be generated using the relatively high gamma voltages. In order to generate the relatively high gamma voltages, the gamma reference voltage selector 45 selects the most significant gamma reference voltage with the high voltage level Vref_H and enables the gamma resistor train 47 to generate the gamma reference voltages with the relatively high voltage levels. As such, the first pixel region on the 321 gate line GL321 can be over-driven so that its response speed can be enhanced. In accordance therewith, deterioration of picture quality due to the RC delay can be prevented.

Also, when the second area is exchanged with the third area, the data voltage being applied to the first pixel region on the $641^{st}$ gate line GL641 varies from the negative voltage level to the positive voltage level. As such, when the data voltage is applied to the first pixel region on the $641^{st}$ gate line GL641, the gamma voltages with the relatively high voltage levels are generated. Moreover, when the third area is exchanged with the fourth area, the data voltage being applied to the first pixel region on the $961^{st}$ gate line GL961 varies from the positive voltage level to the negative voltage level. As such, when the data voltage is applied to the first pixel region on the $961^{st}$ gate line GL961, the gamma voltages with the relatively high voltage levels are generated.

The pixel regions on the other gate line except the first gate line within each area can be normally driven without over-driving. To this end, the gamma reference voltage selector 45 selects the most significant gamma reference voltage with the low voltage level and enables the gamma resistor train 47 to generate the gamma reference voltage with the normal voltage levels.

Although the four divisional column inversion mode has been described as an example of the present embodiment, the divisional column inversion mode can be applied to the LCD devices regardless of the number of divided areas. Alternatively, a eight divisional column inversion mode allowing the LCD panel to be divided into 8 areas and driven in the column inversion mode can over-drive the pixel regions on the first gate line within each area. As such, the eight divisional column inversion mode can prevent deterioration of picture quality. In other words, the divisional column inversion mode LCD device according to the present embodiment can minimize the RC delay on the data line and furthermore uniformly display an image.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

a plurality of gate lines and a plurality of data lines arranged on a substrate;

a data driver configured to apply data voltages to the data lines; and a gamma generator configured to apply a plurality of gamma voltages to the data driver, wherein each data line of the plurality of data lines receives a data voltage which has an inverted polarity with respect to the data voltages applied to the adjacent data lines thereto, wherein the data voltage supplied to each data line is inverted n (n is a natural number) times in polarity for every frame, and is over-driven for the gate lines, where polarity inversions occur, wherein the data line receives the data voltage which has an inverted polarity to those of data voltages on the adjacent data lines thereto, is inverted n times in polarity for every frame, and is over-driven for the gate lines opposite to time points of the polarity inversions, wherein the gamma generator includes:

a gamma reference voltage generation portion configured to derive a plurality of gamma reference voltages from a supply voltage applied from a power supplier; and a gamma voltage generation portion configured to generate the gamma voltages using the gamma reference voltages generated in the gamma reference voltage generation portion, wherein the gamma reference voltage generation portion includes:

a resistor portion configured to generate the plurality of gamma reference voltages by voltage-dividing the supply voltage; and a gamma reference voltage selector serially connected to the resistor portion and configured to generate a most significant gamma reference voltage, wherein the gamma reference voltage selector adjusts a voltage level of the most significant gamma reference voltage and selects voltage levels of the plural gamma reference voltage generated in the resistor portion, wherein the gamma reference voltage selector enables not only the most significant gamma reference voltage to selectively have one of a low voltage level and a high voltage level, but also the gamma reference voltages generated in the resistor portion to selectively have one of normal voltage levels and relatively high voltage levels to the normal voltage levels, wherein the resistor portion includes a plurality of resistors each connected between a plurality of nodes, wherein a voltage on a node close to the gamma reference voltage selector among the nodes within each resistor portion is used as a gamma reference voltage, when the gamma reference voltage is set to be the relatively high voltage levels, and wherein a voltage on a node remote from the gamma reference voltage selector among the nodes within each resistor portion is used as a gamma reference voltage, when the gamma reference voltage is set to be the normal voltage levels.

2. The liquid crystal display device of claim 1, wherein the gamma reference voltage selector enables the most significant gamma reference voltage to have the high voltage level whenever the polarity inversion is performed during every frame.

3. The liquid crystal display device of claim 1, wherein the polarity inversion is performed 4 times for every frame.

4. The liquid crystal display device of claim 1, wherein the polarity inversion is performed 8 times for every frame.

5. The liquid crystal display device of claim 1, wherein the gamma reference voltage selector includes a plurality of serially connected resistors.

* * * * *